United States Patent [19]

Johnson et al.

[11] Patent Number: 4,850,790

[45] Date of Patent: Jul. 25, 1989

[54] HYDRAULICALLY ACTUATED COUPLER FOR INDUSTRIAL, AGRICULTURAL, OR EARTH-MOVING VEHICLE

[75] Inventors: Richard S. Johnson, Wichita; Gary D. Stromberg, Derby, both of Kans.

[73] Assignee: J. I. Case Company, Racine, Wis.

[21] Appl. No.: 211,965

[22] Filed: Jun. 27, 1988

[51] Int. Cl.[4] ..... E02F 3/96

[52] U.S. Cl. ..... 414/723; 91/420

[58] Field of Search ..... 414/723, 699; 91/420

[56] References Cited

U.S. PATENT DOCUMENTS

| | | | |
|---|---|---|---|
| 3,204,793 | 9/1965 | Lane . | |
| 3,269,570 | 8/1966 | Wallberg . | |
| 3,672,521 | 6/1972 | Bauer et al. . | |
| 4,116,347 | 9/1978 | Uchida . | |
| 4,442,912 | 4/1984 | Vette | 91/420 X |
| 4,480,955 | 11/1984 | Andrews et al. | 414/723 |
| 4,545,720 | 10/1985 | Cochran et al. . | |
| 4,583,906 | 4/1986 | Frisbee . | |

FOREIGN PATENT DOCUMENTS 975029 8/1963 United Kingdom .

*Primary Examiner*—Robert J. Spar
*Assistant Examiner*—Donald W. Underwood
*Attorney, Agent, or Firm*—Dressler, Goldsmith, Shore, Sutker & Milnamow, Ltd.

[57] ABSTRACT

In an industrial, agricultural, or earth-moving vehicle, a charging pump, which delivers hydraulic fluid under pressure remaining substantially constant while the vehicle is operating and a coupler are combined. In the coupler, a hydraulically actuated piston-cylinder mechanism is used to wedge a pin into an orifice in an implement, thereby to couple the implement to the vehicle, and to withdraw the pin, thereby to uncouple the implement from the vehicle. A directional valve, which is connected between the pump and the piston-cylinder mechanism, is switchable by an operator of the vehicle between a first stage wherein the directional valve allows hydraulic fluid delivered by the pump to actuate the piston-cylinder mechanism in a forward direction, thereby to wedge the pin into the orifice, and a second stage wherein the directional valve allows hydraulic fluid delivered by the pump to actuate the piston-cylinder mechanism in a reverse direction, thereby to withdraw the pin. A normally closed, pilot actuated check valve, which is connected between the directional valve and the piston-cylinder mechanism, checks flow of hydraulic fluid from the piston-cylinder mechanism to the directional valve when and while the check valve is closed but allows such flow when and while the check valve is opened. The check valve is arranged to be closed when and while the directional valve is switched to the forward stage but to be opened by hydraulic fluid delivered by the pump when and while the directional valve is switched to the reverse stage.

2 Claims, 2 Drawing Sheets

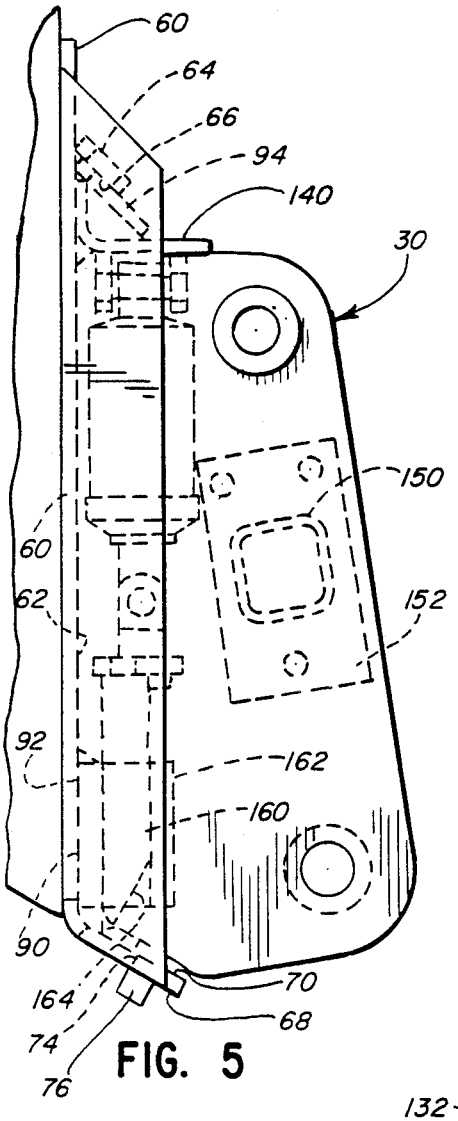
FIG. 5
FIG. 4
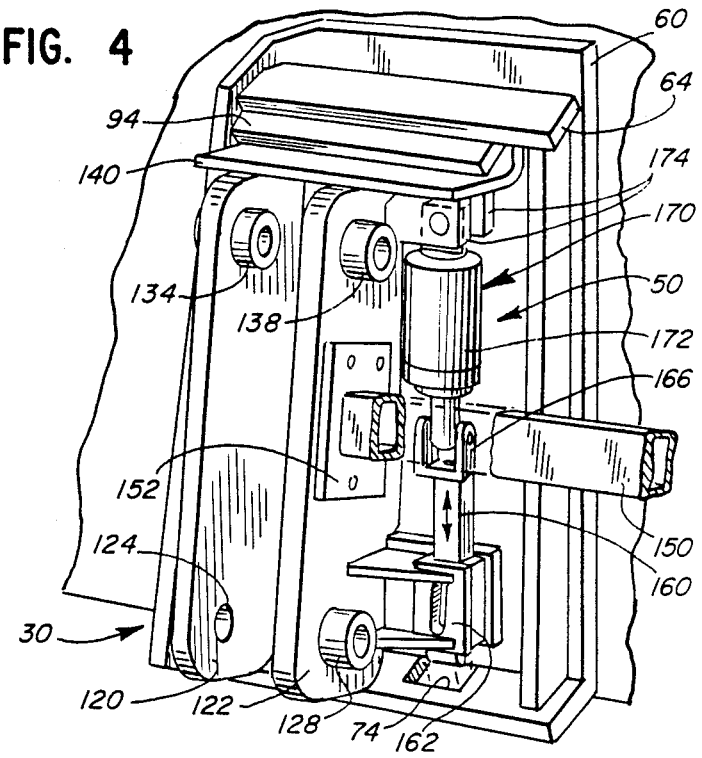
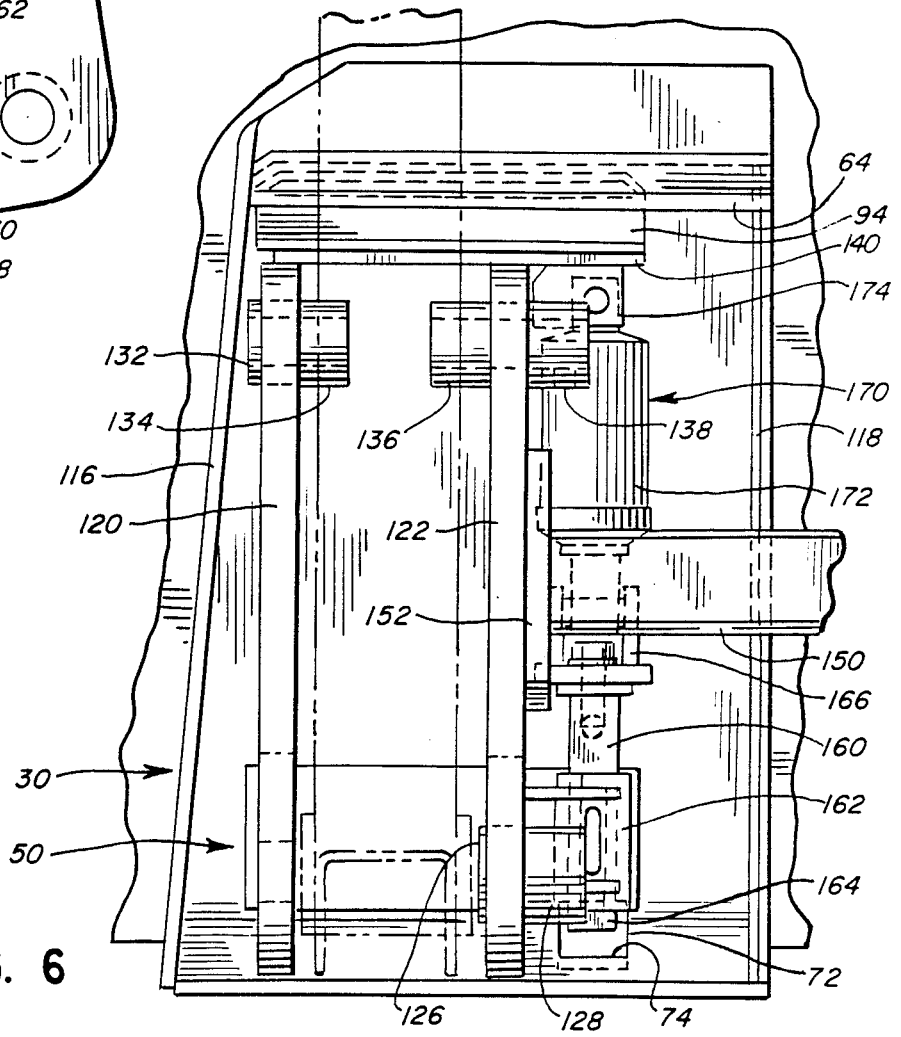
FIG. 6

HYDRAULICALLY ACTUATED COUPLER FOR INDUSTRIAL, AGRICULTURAL, OR EARTH-MOVING VEHICLE

BACKGROUND OF THE INVENTION

This invention pertains to an improved, hydraulically actuated coupler for an industrial, agricultural, or earth-moving vehicle, such as a skid-steer loader, in which the coupler serves to couple an implement to the vehicle and to uncouple the implement from the vehicle.

The implement may be a dirt bucket, a grain bucket, a manure fork, or any other implement for such a vehicle. If the vehicle is a skid-steer loader having lifting arms and tilting cylinders, the coupler can serve to couple the implement to such arms and cylinders and to uncouple the implement therefrom.

Prior couplers are known in which vertically movable, spring-loaded pins are wedged into orifices in an implement so as to couple the implement to such a vehicle. The pins may be withdrawn so as to uncouple the implement. See, e.g., Bauer et al. U.S. Pat. No. 3,672,521 and Cochran et al. U.S. Pat. No. 4,545,720. A disadvantage of those couplers is that, unless the pins are protected so as to prevent their lower ends from striking rocks or other obstacles while the vehicle is operating, the pins can be dislodged inadvertently, whereby the implement can be uncoupled inadvertently.

Prior couplers also are known in which hydraulically actuated pins, or clamps, are employed, which are actuated by hydraulically actuated piston-cylinder mechanisms. See, e.g., Lane U.S. Pat. No. 3,204,793, Wallberg U.S. Pat. No. 3,269,570, and Steelfab British Patent Specification No. 975,029. See, also, Uchida U.S. Pat. No. 4,116,347 and Frisbee U.S. Pat. No. 4,583,906. It is suggested in Wallberg U.S. Pat. No. 3,269,570, column 2, lines 66 and following, that such piston-cylinder mechanisms may be connected to a hydraulic system used for hydraulic control of lifting levers of a loading truck.

One mode of conceivable failure of such a coupler employing hydraulically actuated pins, as actuated by such piston-cylinder mechanisms connected so as to receive hydraulic fluid from a hydraulic system having another function, e.g., to lift a load, is that reverse flow of hydraulic fluid from the piston-cylinder mechanisms actuating the pins may be possible when the hydraulic system is delivering hydraulic fluid for another function, as it then may be possible for hydraulic fluid from the piston and cylinder mechanisms to flow with hydraulic fluid being delivered by the hydraulic system. Thus, if the pins are dislodged inadvertently when reverse flow is possible, the implement can be uncoupled inadvertently.

There has been a need, to which this invention is addressed, for an improved, hydraulically actuated coupler for an industrial, agricultural, or earth-moving vehicle, such as a skid-steer loader.

Hereinbefore, and hereinafter, directional terms such as "front", "back", "frontwardly", "backwardly", "upper", and "lower" are used merely for convenient reference to relative positions of different parts and to relative directions and are not intended as limiting.

SUMMARY OF THE INVENTION

This invention provides an improved, hydraulically actuated coupler for coupling an implement to and uncoupling the implement from an industrial, agricultural, or earth-moving vehicle employing a pump adapted to deliver hydraulic fluid under pressure while the vehicle is operating. In accordance with this invention, the coupler and the pump are combined, in a novel combination.

Preferably, the pump is adapted to deliver hydraulic fluid under substantially constant pressure (e.g., 350 psig) while the vehicle is operating. Accordingly, the pump may be a so-called "charging"pump, of a type used commonly in such a vehicle. See, e.g., Cochran et al. U.S. Pat. No. 4,332,134 and Anderson et al. U.S. Pat. No. 4,475,332 for disclosures of charging pumps in such vehicles. A charging pump is an ideal choice, since it operates continuously and delivers hydraulic fluid at a moderate pressure (e.g., 350 psig) which is more than sufficient for the coupler, as compared to intermittent, higher-pressure pumps that may be used also in such a vehicle.

Broadly, the coupler comprises a pin, a hydraulically actuated piston-cylinder mechanism, a two-stage directional valve, and a check valve, as combined with the pump in a manner to be hereinafter explained.

The pin is adapted to be driven, preferably wedged, into an orifice in the implement so as to couple the implement to the vehicle and to be withdrawn from the orifice so as to uncouple the implement from the vehicle. The piston-cylinder mechanism is adapted to drive the pin into the orifice when such mechanism is actuated in a forward direction. The same mechanism is adapted to withdraw the pin from the orifice when such mechanism is actuated in a reverse direction.

The directional valve is adapted to be switched by an operator of the vehicle between a forward stage and a reverse stage. In the forward stage, the directional valve allows hydraulic fluid delivered by the pump to actuate the piston-cylinder mechanism in the forward direction. In the reverse stage, the directional valve allows hydraulic fluid delivered by the pump to actuate the piston-cylinder mechanism in the reverse direction.

The check valve is connected between the directional valve and the piston-cylinder mechanism so as to allow flow of hydraulic fluid from the directional valve to such mechanism, so as to check flow of hydraulic fluid from such mechanism to the directional valve when and while the check valve is closed, but so as to allow flow of hydraulic fluid from the directional valve to such mechanism when and while the check valve is opened. The check valve is arranged to be closed when and while the directional valve is switched to the forward stage and to be opened by hydraulic fluid delivered by the pump when and while the directional valve is switched to the reverse stage.

Thus, even when the pump is being used to deliver hydraulic fluid for another purpose, e.g., to charge another pump, reverse flow of hydraulic fluid from the piston-cylinder mechanism actuating the pin is checked by the check valve, which thus prevents the implement from being uncoupled inadvertently if the pin strikes a rock or another obstacle.

Desirably, the coupler may comprise a pair of such pins and a pair of such piston-cylinder mechanisms, whereupon the piston-cylinder mechanisms may be connected in parallel, via the check valve and the directional valve, to the pump.

These and other objects, features, and advantages of this invention will be understood from the following description of a preferred embodiment of this invention with reference to the accompanying drawings.

BRIEF DESCRIPTION OF THE DRAWINGS

FIG. 4 is a partly fragmentary, perspective view of one of two male coupling structures and one of two female coupling structures, as used with other components of the coupler to couple the bucket to the skid-steer loader.

FIG. 5 is a further enlarged, partly fragmentary, elevational view of one side of the male and female coupling structures shown in FIG. 4.

FIG. 6 is a similarly enlarged, partly fragmentary, elevational view of the back of the male and female coupling structures shown in FIGS. 4 and 5.

DETAILED DESCRIPTION OF PREFERRED EMBODIMENT

Figure 1:
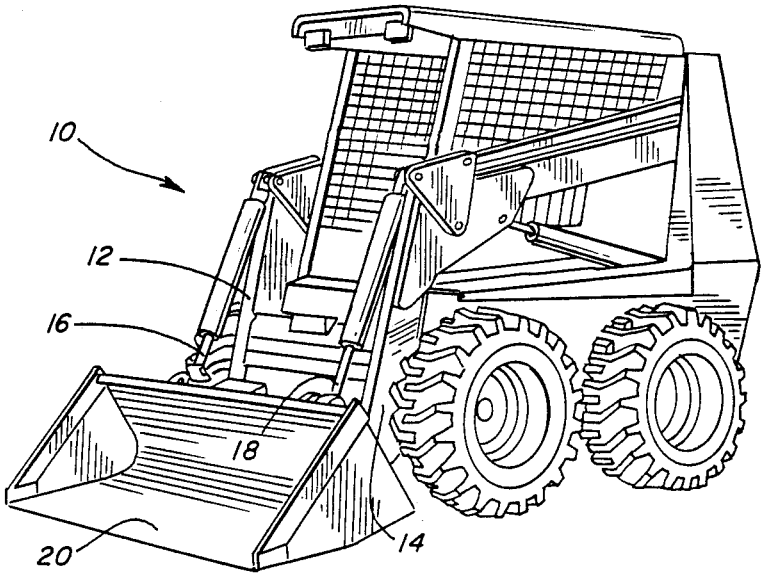
FIG. 1 is a perspective view of a skid-steer loader incorporating a charging pump and a coupler, in a combination constituting a preferred embodiment of this invention, along with a bucket coupled by the coupler to the skid-steer loader.
Figure 2:
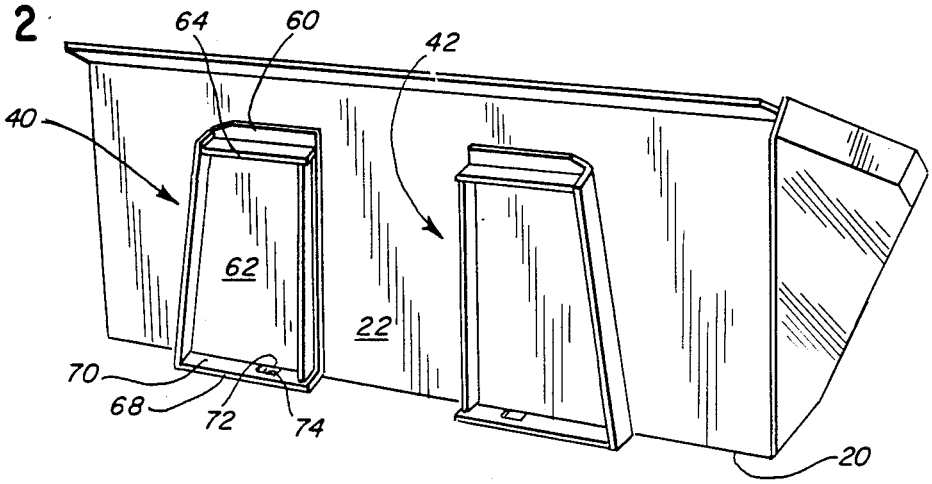
FIG. 2 is a perspective view of the bucket, as removed from the skid-steer loader and rotated from front to back, on an enlarged scale compared to FIG. 1.

As shown in FIG. 1, a skid-steer loader 10, which may be also called a front-end loader, has, at its front end, a pair of hydraulically operated, load-lifting arms 12, 14, and a pair of hydraulically operated, load-tilting, piston-cylinder mechanisms respectively including load-tilting pistons 16, 18. A bucket 20, which is a representative example of various implements that are useful with such a loader, is coupled to the loader 10, in a manner to be hereinafter described, so that the bucket 20 may be selectively lifted and lowered, by means of the load-lifting arms 12, 14, and so that the bucket 20 may be selectively tilted, by means of the load-tilting pistons 16, 18. Similar loaders have been made and sold for many years by J. I. Case Company of Racine, Wisconsin, under its "Uni-Loader"trademark. Except as described hereinbelow, the bucket 20 is similar to buckets that have been made and sold for many years by J. I. Case Company.

As shown in FIGS. 2 through 6, a coupler 30 is provided, which enables the bucket 20 to be selectively coupled to and uncoupled from the loader 10. Broadly, the coupler 30 comprises a pair of female coupling structures 40, 42, and a pair of male coupling structures 50 (one shown). The female coupling structures and the male coupling structures respectively are made of steel parts, which are welded together, except as described hereinafter. The female coupling structures, which are mirror images of each other, are welded integrally to the bucket 20 in laterally spaced relation to each other. The male coupling structures, which are mirror images of each other, are mounted operatively to the load-lifting arms and load-tilting pistons of the loader 10 in laterally spaced relation to each other. Thus, the load-lifting arm 12 is journalled at its distal end to the male coupling structure 50, and the load-tilting piston 16 is journalled at its distal end to the male coupling structure 50. Also, the load-lifting arm 14 is journalled at its distal end to the other male coupling structure, and the load-tilting piston 18 is journalled at its distal end to the same male coupling structure. Hence, when the male coupling structure 50 is coupled to the female coupling structure 40 and the other male coupling structure is coupled to the female coupling structure 42, the bucket 20 may be selectively lifted and lowered, by means of the load-lifting arms 12, 14, and may be selectively tilted by means of the load-tilting pistons 16, 18.

Because the female coupling structures are mirror images of each other and the male coupling structures are mirror images of each other, detailed descriptions of the female coupling structure 40 and the male coupling structure 50 will suffice, there being no need for what would be essentially duplicative descriptions of the other male and female coupling structures.

As shown in FIGS. 2 and 4 through 6, the female coupling structure 40, which is integral with the bucket 20, includes an upstanding back plate 60, which has a back surface 62, and which in the preferred embodiment, as shown and described, is a separate plate welded to a back wall 22 of the bucket 20. An upper flange 64 is welded to the plate 60, so as to extend rigidly and backwardly from the plate 60. The flange 64 has a lower surface 66 (see FIG. 5) sloping downwardly and backwardly at an acute angle of approximately 45° from the back surface 62 of the plate 60. The plate 60 is bent, as shown, so as to form a lower flange 68 extending rigidly and backwardly from the back surface 62 of the plate 60. The lower flange 68 has an upper surface 70 sloping downwardly and backwardly at an obtuse angle of approximately 120° from the back surface 62 of the plate 60. The lower flange 68 is provided with an enlarged, generally rectangular orifice 72, having a back edge 74, which is reinforced by means of a lateral member 76 welded to the underside of the flange 68, for a purpose to be later described.

As shown in FIGS. 4 through 6, the male coupling structure 50, which is adapted to be operatively mounted to the load lifting arms 12, 14, and load-tilting pistons 16, 18, in a manner to be later described, includes a short upstanding front plate 90 having a front surface 92, which in the illustrated embodiment is adapted to bear against the back surface 62 of the plate 60 when the male coupling structure 50 is coupled to the female coupling member 40. Thus, as shown, there is no gap or space between the plate 90 and the plate 60 when the male coupling structure 50 is coupled to the female coupling structure 40. It is to be here understood, however, that it is not necessary for there to be no gap or space therebetween. An upper flange 94, which is welded to the plate 90 in a manner to be hereinafter described, has a sloping upper surface 96, which is adapted to bear against the lower surface 66 of the flange 64 when the male coupling structure 50 is coupled to the female coupling structure 40.

So as to facilitate coupling of the male coupling member 50 to the female coupling member 40, the outer corners of the flange 94 are beveled, as shown. Moreover, guides 116, 118, are welded to the back wall 22 of the bucket 20. The guides 116, 118, are not parallel to each other but converge as they run upwardly, so as to cooperate with the beveled corners of the flange 94 in causing the flange 94 to become located properly between the guides 116, 118, as the flange 94 is lifted under the flange 64.

Moreover, the male coupling structure 50 includes a left-hand vertical bracket 120 and a right-hand vertical bracket 122. A pin (not shown) passing through a circular aperture 124 in the bracket 120, passing through suitable fittings (not shown) at the distal end of the load-lifting arm 12, and passing through bushings 126, 128, mounted on opposite sides of a similar aperture in the bracket 122, connects the male coupling structure 50 operatively, and semi-permanently, to the load-lifting arm 12 in a known manner, so as to permit pivotal movement of the male coupling structure with respect to the load-lifting arm 12, about a horizontal axis disposed transversely with respect to the loader 10. A pin (not shown) passing through bushings 132, 134, on opposite sides of a circular aperture in the bracket 120, passing through suitable fittings (not shown) at the distal end of the load-tilting piston 16, and passing through bushings 136, 138, on opposite sides of a circular aperture in the bracket 122 connects the male coupling structure 50 operatively, and semi-permanently, to the load-tilting piston 16 in a known manner, so as to permit pivotal movement of the male coupling structure with respect to the load-tilting piston 16.

The upper flange 94 is welded to a lateral brace 140, which is welded to the top edges of the vertical brackets 120, 122. The lateral brace not only supports the upper flange 94 but also supports a piston-cylinder mechanism to be later described.

As shown in FIGS. 4 through 6, a tubular brace 150 is welded at its opposite ends respectively to a mounting plate 152, which is bolted onto the bracket 122 of the male coupling structure 50, and to a similar plate, which is bolted onto a similar bracket of the other male coupling structure. The brace 150 resists relative twisting movement of the male coupling structures and maintains a proper spacing between the male coupling structures.

As shown in FIGS. 4 through 6, a pin 160 is arranged to reciprocate vertically in a guide 162, which is welded to the plate 90. The pin 160 has a wedge face 164 facing backwardly at its lower end. The upper end of the pin 160 is coupled by a suitable coupling 166, to the lower end of the piston rod 168 of a piston-cylinder mechanism 170, which is coupled, at the upper end of the cylinder 172 of such mechanism 170, to a pair of flanges 174 welded to the underside of the lateral brace 140.

When the pin 160 is driven downwardly by the piston-cylinder mechanism 170, the pin 160 is wedged into the orifice 72, such that the wedge face 164 at the lower end of the pin 160 wedges against the back edge 74 of the orifice 72 and against the lateral member 76 reinforcing such edge 74, whereby the bucket 20 is coupled, via the coupler 30, to the loader 10. When the pin 160 is driven upwardly by the piston-cylinder mechanism 170, the pin 160 is withdrawn from the orifice 72, whereby the bucket 20 is uncoupled from the loader 10.

Figure 3:
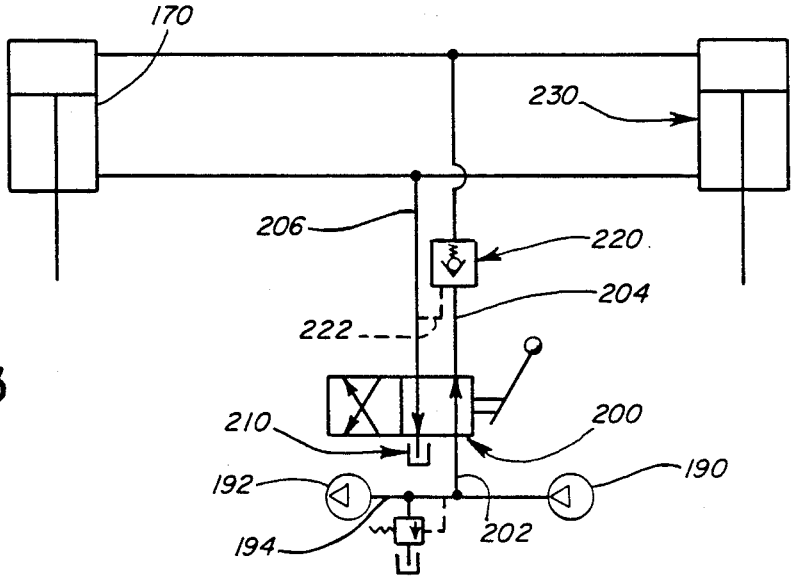
FIG. 3 is a schematic diagram of the charging pump and another pump, which is charged by the charging pump, along with other hydraulic components of the coupler.

As diagrammed in FIG. 3, the loader 10 comprises a charging pump 190, which is used to charge another pump 192 with hydraulic fluid, via a hydraulic line 194. The pump 192 is representative of other pumps used in such loaders for various functions, e.g., to operate hydrostatic drives, to actuate lifting levers, or to actuate tilting cylinders. The charging pump 190 operates continuously, while the loader 10 is operating, and delivers hydraulic fluid at a moderate, substantially constant pressure (e.g., 350 psig) which is more than sufficient to actuate the piston-cylinder mechanism 170 in either direction and to couple the bucket 20 effectively to the loader 10.

As diagrammed also in FIG. 3, the coupler 30 comprises a two-stage directional valve 200, which is adapted to be switched by an operator of the loader 10 between a first or forward stage and a second, or reverse stage. Controls for the directional valve 200 may be located so that the operator can switch the valve 200 without having to leave the operator's seat in the loader 10. The directional valve 200 is connected to the line 194, via a line 202, so as to receive hydraulic fluid delivered by the charging pump 190.

When switched to its forward stage, in which it is shown in FIG. 3, the directional valve 200 allows hydraulic fluid delivered by the charging pump 190 to flow, via a line 204, to the piston-cylinder mechanism 170 so as to actuate such mechanism 170 in its forward direction, whereby such mechanism 170 drives the pin 160 downwardly. Moreover, the directional valve 200 allows hydraulic fluid displaced in such mechanism 170 to flow, via a line 206 and the directional valve 200, to a reservoir 210, from which the pumps 190, 192, draw hydraulic fluid.

When switched to its reverse stage, the directional valve 200 allows hydraulic fluid delivered by the charging pump 190 to flow, via the line 206, to the piston-cylinder mechanism 170, so as to actuate such mechanism 170, in its reverse direction, whereby such mechanism 170 drives the pin upwardly. Moreover, the directional valve 200 allows hydraulic fluid displaced in such mechanism 170 to flow, via the line 204, to the reservoir 210.

As diagrammed also in FIG. 3, the coupler 30 comprises a normally closed, pilot actuated, check valve 220, which is connected in the line 204 between the directional valve 200 and the piston-cylinder mechanism 170. The check valve 220 is arranged to allow flow of hydraulic fluid from the directional valve 200 to such mechanism 170. Being normally closed, the check valve 220 is arranged to be closed, so as to check reverse flow of hydraulic fluid, when and while the directional valve 200 is switched to the forward stage. Furthermore, the check valve 220 is arranged to be opened by hydraulic fluid delivered by the pump 190, via the directional valve 200 and a line 222 connected to the line 206, when and while the directional valve 200 is switched to its reverse stage.

Accordingly, the check valve 220 checks flow of hydraulic fluid from the piston-cylinder mechanism 170 to the directional valve 200 when and while the check valve 220 is closed, whereby inadvertent uncoupling of the bucket 20 is prevented if the lower end of the pin 160 strikes a rock or other obstacle while the charging pump 190 is delivering hydraulic fluid to the pump 192. Additionally, the check valve 220 allows flow of hydraulic fluid from such mechanism 170 to the directional valve 200 when and while the check valve 220 is opened, whereby intentional uncoupling of the bucket 20 is enabled. A suitable check valve is Model SPC2-10-B-6T, as distributed by Modular Controls Corporation of Villa Park, Illinois.

As diagrammed also in FIG. 3, a piston-cylinder mechanism 230, which is similar to the piston-cylinder mechanism 170 and which is a component of the other male coupling structure, is connected in parallel, via the check valve 220 and the directional valve 200, to the pump 190. Thus, when the piston-cylinder mechanism 170 is actuated in its forward direction, the piston-cylinder mechanism 230 is actuated in its forward direction. Also, when the piston-cylinder mechanism 170 is actuated in its reverse direction, the piston-cylinder mechanism 230 is actuated in its reverse direction.

Various modifications may be made in and to the aforenoted combination of a charging pump and a coupler without departing from the scope and spirit of this invention.

We claim:

1. In an industrial, agricultural, or earth-moving vehicle having a hydrostatic drive, a combination comprising:

(a) a pump arranged to operate the hydrostatic drive;

(b) a charging pump arranged to deliver hydraulic fluid continuously and under substantially constant pressure while the vehicle is operating and to deliver hydraulic fluid to the first-mentioned pump; and (c) a coupler mounted to the vehicle and adapted to couple an implement to the vehicle and to uncouple the implement from the vehicle, the coupler comprising:

(1) a pin adapted to be driven into an orifice in the implement so as to couple the implement to the vehicle and to be moved oppositely so as to uncouple the implement from the vehicle; and (2) a hydraulically actuated piston-cylinder mechanism adapted to drive the pin into the orifice when the piston-cylinder mechanism is actuated in a forward direction and to withdraw the pin from the orifice when the piston-cylinder mechanism is actuated in a reverse direction;

(3) a two-stage directional valve connected between the charging pump and the piston-cylinder mechanism and adapted to be switched by an operator of the vehicle between a forward stage wherein the directional valve allows hydraulic fluid delivered by the charging pump to actuate the piston-cylinder mechanism in the forward direction and a reverse stage wherein the directional valve allows hydraulic fluid delivered by the charging pump to actuate the piston-cylinder mechanism in the reverse direction; and (4) a check valve connected between the directional valve and the piston-cylinder mechanism so as to allow flow of hydraulic fluid from the directional valve to the piston-cylinder mechanism, so as to check flow of hydraulic fluid from the piston-cylinder mechanism to the directional valve when and while the check valve is closed, but so as to allow flow of hydraulic fluid from the piston-cylinder mechanism to the directional valve when and while the check valve is opened, the check valve being arranged to be closed, so as to prevent flow of hydraulic fluid from the piston-cylinder mechanism, through the directional valve, to the first-mentioned pump along with hydraulic fluid being delivered by the charging pump to the first-mentioned pump, when and while the directional valve is switched to the forward stage, the check valve being arranged to be opened by hydraulic fluid delivered by the charging pump through the directional valve when and while the directional valve is switched to the reverse stage.

2. The combination of claim 1 wherein the pin is adapted to be wedged into the orifice.

* * * * *